US008273515B2

(12) United States Patent
Ariyoshi et al.

(10) Patent No.: US 8,273,515 B2
(45) Date of Patent: Sep. 25, 2012

(54) TONER AND METHOD OF MANUFACTURING THE SAME, TWO-COMPONENT DEVELOPER, DEVELOPING DEVICE AND IMAGE FORMING APPARATUS

(75) Inventors: Satoru Ariyoshi, Osaka (JP); Katsuru Matsumoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 380 days.

(21) Appl. No.: 12/621,049

(22) Filed: Nov. 18, 2009

(65) Prior Publication Data

US 2010/0124441 A1 May 20, 2010

(30) Foreign Application Priority Data

Nov. 19, 2008 (JP) ..... P2008-296089

(51) Int. Cl.
*G03G 9/00* (2006.01)

(52) U.S. Cl. ..... 430/109.1; 430/108.1; 430/108.8; 430/109.4

(58) Field of Classification Search ..... 430/108.1, 430/108.8, 109.1, 109.4
See application file for complete search history.

(56) References Cited

U.S. PATENT DOCUMENTS

| | | | | |
|---|---|---|---|---|
| 7,129,013 | B2 * | 10/2006 | Higuchi et al. | 430/108.4 |
| 2003/0162115 | A1 * | 8/2003 | Uchinokura et al. | 430/108.22 |
| 2006/0222993 | A1 * | 10/2006 | Morales-Tirado et al. | 430/110.2 |
| 2007/0218385 | A1 | 9/2007 | Kojima et al. | |

FOREIGN PATENT DOCUMENTS

| | | |
|---|---|---|
| CN | 101038452 A | 9/2007 |
| JP | 3-84556 | 4/1991 |
| JP | 5-216271 | 8/1993 |
| JP | 2004-295110 | 10/2004 |
| JP | 2007-148200 | 6/2007 |
| JP | 2007-212905 | 8/2007 |

* cited by examiner

*Primary Examiner* — Mark F Huff
*Assistant Examiner* — Stewart Fraser
(74) *Attorney, Agent, or Firm* — Nixon & Vanderhye P.C.

(57) ABSTRACT

A toner containing a lignin resin, a carbon-neutral biomass polymer having a low environmental load and taking global environmental protection into account, as a constitutional component of a binder resin, and having a wide fixing non-offset range and an excellent fixing property, is provided. The toner contains at least a binder resin, a colorant, and a release agent. Furthermore, in the toner, the binder resin includes a resin A that is a lignin resin and a resin B that is another resin component, and the resin B has a peak top molecular weight of $10^3$ to $10^4$ and an acid number of 20 or less.

7 Claims, 3 Drawing Sheets

TONER AND METHOD OF MANUFACTURING THE SAME, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2008-296089, which was filed on Nov. 19, 2008, the contents of which are incorporated herein by reference in their entirety.

BACKGROUND OF THE INVENTION

1. Field of the Invention

The present invention relates to a toner for the use in developing latent images and a method of manufacturing thereof, a two-component developer, a developing device and an image forming apparatus, in an image forming apparatus of an electrophotographic system, an electrostatic printing system or the like.

2. Description of the Related Art

Toners for visualizing latent images are used in various image forming processes and one example thereof is use in an electrophotographic image forming process. Image forming apparatuses employing the electrophotographic image forming process generally perform a charging step of uniformly charging a photosensitive layer on the surface of a photoreceptor drum serving as an image bearing member; an exposure step of projecting signal light corresponding to an original image on the surface of the photoreceptor drum that is being charged to form an electrostatic latent image; a development step of visualizing the electrostatic latent image on the surface of the photoreceptor drum by supplying electrophotographic toner thereto; a transfer step of transferring a toner image formed on the photoreceptor drum to a recording medium such as paper and OHP sheets; a fixing step of fixing the toner image onto the recording medium under heat, pressure and the like; and a cleaning step of eliminating toner and the like remaining on the surface of the photoreceptor drum after the toner image is transferred, with a cleaning blade and for cleaning the surface of the photoreceptor drum, to subsequently form a desired image on the recording medium. Transfer of a toner image onto a recording medium may be performed through an intermediate transfer medium.

The electrophotographic toner is obtained in a manner that toner material including a binder resin and a colorant as main components, to which a release agent, a charge control agent and the like are added when necessary, and are mixed, melt-kneaded, cooled and solidified, then subjected to a knead-pulverization method for pulverization and classification or to a polymerization method represented by a suspension polymerization method, an emulsification polymerization method and the like.

In recent years, various efforts have been made in various fields from a viewpoint of global environmental protection, one of which is to decrease environmental load by reducing waste products. Today, a number of raw materials are manufactured from oil and reducing heat quantity necessary for manufacturing such raw materials and burning the waste products thereof and carbon dioxide generated accordingly, is important from the viewpoint of suppression of global warming. On the other hand, carbon dioxide generated by burning plants that took in carbon dioxide from the atmosphere through photosynthesis does not change the total amount of carbon dioxide in the atmosphere, because the carbon dioxide that the plants took in was originally present in the atmosphere. This is so-called carbon neutral and since a plant-derived material is carbon-neutral and use thereof is able to fix the carbon dioxide amount in the atmosphere, leading to suppression of global warming, much attention has been focused thereon.

Furthermore, for the problem of depletion of fossil fuels including oil, efforts have been made to use resources derived from natural products that are non-oil resources, and the plant-derived material particularly attracts attention.

The plant-derived material is generally called a biomass, and a plastic made from biomass is called by various terms, such as a biomass polymer, a biomass plastic, or an oil-free polymer material. Among the biomass, lignin is a natural polymer present in trees and is obtainable from wood or wood-based waste products, and from a viewpoint of improving the global environment and an effective use of resources and the like, attention has been focused thereon in recent years.

Also in the electrophotographic field, efforts have been made to take into consideration the global environment, specifically environmental safety, reduction of waste products, energy saving and the like and use of biodegradable resins using biomass or the like is proposed.

Japanese Unexamined Patent Publication JP-A 5-216271 (1993) discloses electrophotographic toner that contains, with consideration for global environmental protection, resins obtained by esterifying or etherifying lignin and cellulose as components constituting the binder resin in the toner, and still has a sufficient anti-offset property and a low-temperature fixing property in fixing and causes no entanglement to a fixing roller.

For fixing a toner image transferred on the recording medium such as paper and OHP sheets, a contact heat fixing method represented by a heating roller and the like is often used and the fixing property of toner to the recording medium in this method is able to be indicated by an extent of a fixing non-offset range that is a temperature range capable of fixing between a minimum fixing temperature at which a low-temperature offset does not appear and a temperature at which a high-temperature offset starts to appear.

To improve the fixing property of toner to the recoding medium, that is, to obtain a toner having a wide fixing non-offset range, use of a resin having a cross-linked structure as the binder resin contained in the toner and use of a resin including high-molecular-weight substances and low-molecular-weight substances are proposed. However, when a ratio of the cross-linked components in the binder resin or the high-molecular-weight substances is increased to improve the anti-high-temperature offset property of the toner, melt viscosity of the binder resin is increased to make the low-temperature fixing property of the toner insufficient. Therefore, to obtain a toner having a wide fixing non-offset range, it is important that blending balance and physical properties of the resin components in the binder resin are controlled.

In the technology disclosed in JP-A 5-216271, the content rate of the resin obtained by esterifying or etherifying lignin and cellulose as components constituting the binder resin, and another component of the binder resin are unclear, therefore it is not said that the blending balance and physical properties of the resin components in the binder resin are controlled, as a result, there is a case that the toner has a narrow fixing non-offset range to deteriorate the fixing property.

SUMMARY OF THE INVENTION

Accordingly, an object of the present invention is to provide a toner containing a lignin resin, that is a carbon-neutral biomass polymer having a low environmental load with consideration for global environmental protection, as a constitutional component of the binder resin, the toner which has a wide fixing non-offset range and an excellent fixing property, and a method for manufacturing thereof. Furthermore, a two-component developer using the toner, a developing device for developing using the developer, and an image forming apparatus including the developing device are provided.

The invention provides a toner comprising toner particles containing at least a binder resin, a colorant and a release agent, the binder resin including a resin A that is a lignin resin and a resin B that is another resin component, and the resin B having a peak top molecular weight of $10^3$ to $10^4$ and an acid number of 20 or less.

According to the invention, the toner comprises toner particles containing at least a binder resin, a colorant and a release agent. The binder resin includes a resin A that is a lignin resin and a resin B that is another resin component, and the resin B has a peak top molecular weight of $10^3$ to $10^4$ and an acid number of 20 or less. Since the binder resin constituting the toner contains the resin A that is a lignin resin, a carbon-neutral biomass polymer, the toner is able to be a toner having a low environmental load with consideration for global environmental protection. The lignin resin is a resin having a higher melt viscosity property, compared to polyester resins generally used as the binder resin, thus the toner containing the lignin resin in the binder resin results in a toner having a narrow fixing non-offset range and a poor fixing property. Thus, in the invention, in addition to the resin A that is the lignin resin, a resin B having a specific peak top molecular weight and acid number is contained in the binder resin constituting the toner, and it is thereby possible to suppress deterioration of the fixing property caused by containing the lignin resin and to obtain a toner having a wide fixing non-offset range and an excellent fixing property.

When the peak top molecular weight of the resin B is less than $10^3$, resin strength of the resin B becomes too low and even by mixture thereof with the resin A, the resin strength obtainable is insufficient, thus it is impossible to obtain sufficient effect to suppress deterioration of the fixing property caused by containing the lignin resin. When the peak top molecular weight of the resin B exceeds $10^4$, the melt viscosity becomes too high, thus it is impossible to obtain a toner having a wide fixing non-offset range and an excellent fixing property.

Further, when the acid number of the resin B exceeds 20, the melt viscosity after mixture becomes high and it is impossible to obtain a toner having a wide fixing non-offset range and an excellent fixing property.

Further, in the invention, it is preferable that a ratio of the resin A in the binder resin is 20 to 50% by weight.

According to the invention, the ratio of the resin A in the binder resin is 20 to 50% by weight. When the ratio of the resin A that is the lignin resin in the binder resin is less than 20% by weight, a lignin-resin content is so small that effect on global environmental protection is too small. When the ratio of the resin A that is the lignin resin in the binder resin exceeds 50% by weight, the resin B effect to suppress the deterioration of the fixing property caused by containing the lignin resin is insufficient, thus the fixing property of the toner deteriorates.

Further, in the invention, it is preferable that the lignin resin as the resin A is lignosulfonic acid.

According to the invention, the lignin resin as the resin A is lignosulfonic acid. By using the lignosulfonic acid as the resin A, the hydrophobic structure and the sulfonic group in the molecule act like a surfactant and allow the binder resins, irrespective of the type of the resin B, to be uniformly mixed each other.

Further, the invention provides a method for manufacturing the toner mentioned above, comprising:

a pre-mixing step of mixing at least a binder resin including a resin A that is a lignin resin and a resin B that is another resin component, a colorant and a release agent to obtain a mixture;

a melt-kneading step of melt-kneading the mixture obtained in the pre-mixing step to obtain a melt-kneaded material;

a pulverizing step of pulverizing the melt-kneaded material obtained in the melt-kneading step to obtain a pulverized material; and a classifying step of classifying the pulverized material obtained in the pulverizing step by removing excessively pulverized particles and coarse particles therefrom.

According to the invention, the manufacturing method for manufacturing the toner includes a pre-mixing step, a melt-kneading step, a pulverizing step, and a classifying step. In the pre-mixing step, mixed are at least a binder resin including a resin A that is a lignin resin and a resin B that is another resin component, a colorant and a release agent to obtain a mixture. In the melt-kneading step, the mixture obtained in the pre-mixing step is melt-kneaded to obtain a melt-kneaded material. In the pulverizing step, the melt-kneaded material obtained in the melt-kneading step is pulverized to obtain a pulverized material. Then, in the classifying step, the pulverized material obtained in the pulverizing step is classified by removing excessively pulverized particles and coarse particles therefrom. In this way, the toner is able to be manufactured with simple equipment and at low cost.

Further, the invention provides a two-component developer comprising the toner mentioned above and a carrier.

According to the invention, the two-component developer contains the toner mentioned above and a carrier. Thereby, it is possible to obtain a two-component developer having a low environmental load with consideration for global environmental protection, and having an excellent fixing property.

Further, the invention provides a developing device that carries out development using the developer containing the toner mentioned above or the two-component developer mentioned above.

According to the invention, the developing device carries out development using the developer containing the toner or the two-component developer. Thereby, it is possible to form a toner image having an excellent fixing property in a state where the environmental load is law and global environmental protection is taken into consideration.

The invention provides an image forming apparatus comprising the developing device mentioned above.

According to the invention, the image forming apparatus includes the developing device capable of forming a toner image having an excellent fixing property. Thereby, it is possible to form high-quality images stably without causing fixing failure problems for a long time.

Further, in the invention, it is preferable that the image forming apparatus comprises a latent image bearing member, a charging section for charging a surface of the latent image bearing member, an exposure section for projecting signal light on the surface of the latent image bearing member that is being charged to form an electrostatic latent image, the above-mentioned developing device for supplying a developer to the electrostatic latent image on the surface of the latent image bearing member to form a toner image, a transfer section for transferring the toner image on the surface of the latent image bearing member to a recording medium, and a fixing section for fusing the toner image transferred on the recording medium under heat and pressure and fixing the fused toner image to the recording medium.

According to the invention, the image forming apparatus includes a latent image bearing member, a charging section for charging a surface of the latent image bearing member, an exposure section for projecting signal light on the surface of the latent image bearing member that is being charged to form an electrostatic latent image, the developing device for supplying a developer to the electrostatic latent image on the surface of the latent image bearing member to form a toner image, a transfer section for transferring the toner image on the surface of the latent image bearing member to a recording medium, and a fixing section for fixing the toner image transferred on the recording medium onto the recording medium under heat and pressure. According to the image forming apparatus of the invention, the fixing section thermally melts the toner image developed by the developing device under heat and pressure, and fixes it onto the recording medium, thereby, the toner is able to effectively exert physical properties while realizing both the excellent fixing property and heat preservation stability.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
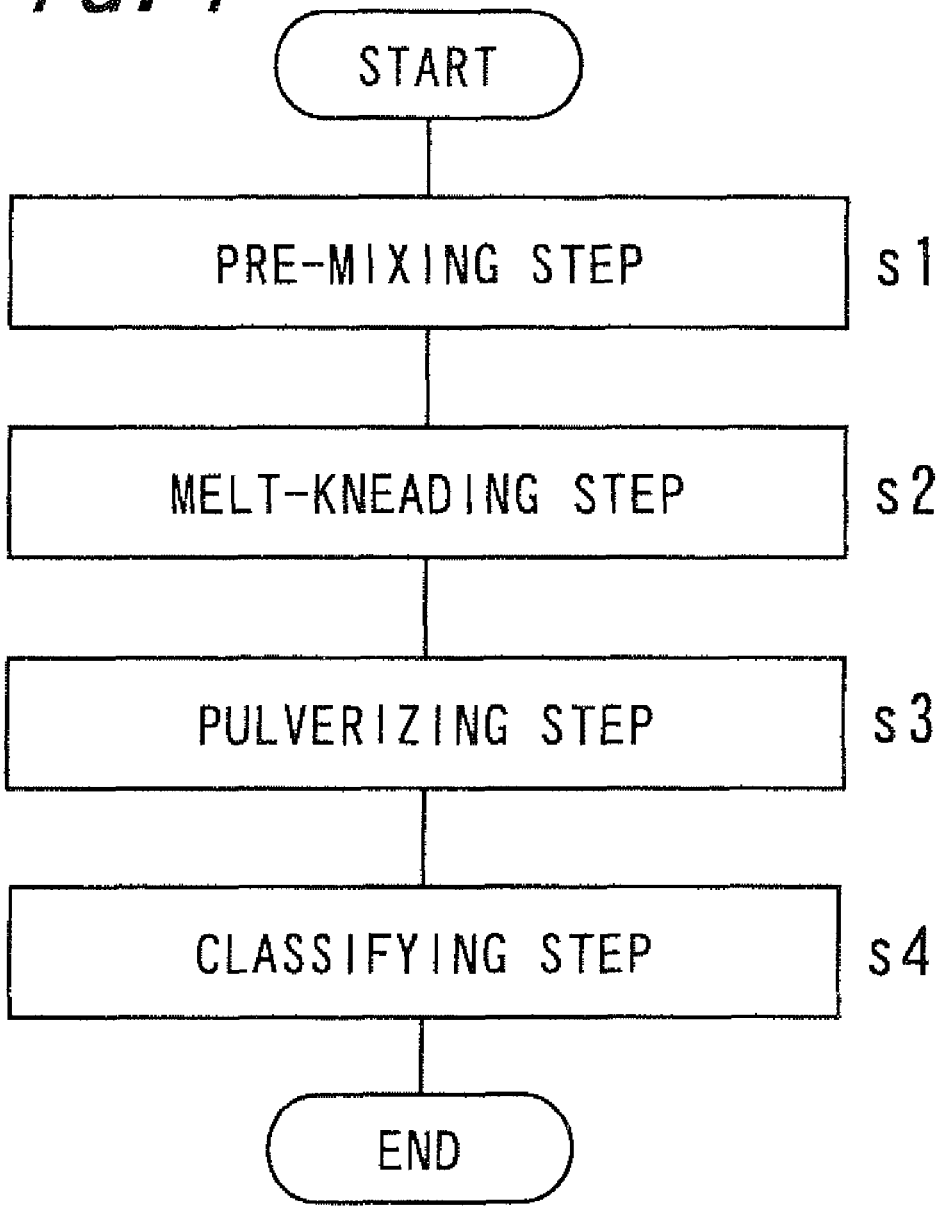
FIG. 1 is a flowchart showing a method of manufacturing a toner according to the invention.

Now referring to the drawings, preferred embodiments of the invention are described below.

A toner of the invention contains at least a binder resin, a colorant, and a release agent. The binder resin includes a resin A that is a lignin resin, and a resin B that is another resin component.

The lignin resin used in the invention as the resin A includes lignin-based material such as lignin present with cellulose in wood and a derivative thereof, a lignophenol derivative, a lignocellulose degraded product, but not particularly limited thereto.

Lignin and the derivative thereof take various forms depending on a method for separating lignin from a plant body, examples of which include "lignin digested with acetic acid" obtained by digesting wood chips with acetic acid and hydrochloric acid in high temperatures, "digested and blasted lignin" obtained by treating with saturated water vapor in high pressure and rapidly releasing the pressure, "kraft lignin" obtained by digesting wood chips using a mixed aqueous solution of sodium hydroxide and sodium sulfate as a digestion liquor in high temperatures, "lignosulfonic acid" obtained by digesting wood powder with neutral or slightly alkaline sulfite solution in high temperatures, "organosolv lignin" obtained by delignifying with organic solvent such as alcohol, ethyl acetate, low molecular organic acid mainly consisting of acetic acid, phenol, and ethanolamine, as well as a salt thereof such as sodium, calcium, and magnesium.

A lignophenol derivative is obtained from a phenol derivative phase among separation phases consisting of a phenol derivative phase (organic phase) and a concentrated acid phase (aqueous phase) obtained by adding a phenol derivative to lignocellulose material containing lignin and thereafter adding a concentrated acid thereto. By treating the lignocellulose material with the phenol derivative, lignin is extracted from the lignocellulose material as the lignophenol derivative.

Note that, the lignocellulose materials containing lignin include woody materials such as wood powder, wood chips, sawdust, waste material, end material, and barks; and various plant materials such as straws, bagasses, chaffs, beet pulp. Further, paper such as waste paper and pulp may be used therefor. Furthermore, the phenol derivatives serving as raw material for producing the lignophenol derivative includes monovalent phenol such as phenol, cresol, alkylphenol, methoxyphenol, and naphthol; divalent phenol such as catechol, resorcinol, and hydroquinone; and trivalent phenol such as pyrogallol. Examples of the concentrated acid used for extracting aqueous material include sulfuric acid of concentrations not lower than 65% by weight, phosphoric acid of not lower than 85% by weight, hydrochloric acid of not lower than 38% by weight, p-toluenesulfonic acid, trifluoroacetic acid, trichloroacetic acid, and formic acid.

Decomposition product of lignocellulose is obtained by decomposing lignin-containing lignocellulose material with phenol compounds, polyhydric alcohol, cyclic ester or the like in the presence of acid catalyst or alkali catalyst. Alternatively, the one is obtained by decomposing lignocellulose material with compounds such as hydroxycarboxylic acid, dicarboxylic acid, amino alcohol or the like.

The acid catalysts used for decomposing include sulfuric acid, hydrochloric acid, toluenesulfonic acid, phenolsulfonic acid, aluminum chloride, zinc chloride, and boron trifluoride. The alkali catalysts include metal hydroxide such as sodium hydroxide, potassium hydroxide or calcium hydroxide; metal carbonate such as calcium carbonate; and amine such as ammonia or monoethanolamine. Various decomposition agents include phenol compound such as phenol, cresol, xylenol, resorcinol, catechol, or bisphenol A; polyhydric alcohol such as ethylene glycol, propylene glycol, trimethylene glycol, polyethylene glycol, glycerin, 1,4-butanediol, or 1,6-hexanediol; cyclic ester such as propiolactone, β-butyrolactone, δ-valerolactone, ϵ-caprolactone, or trimethyl carbonate; hydroxycarboxylic acid such as glycolic acid, lactic acid, 2-hydroxybutyric acid, 2-hydroxy-2-methylpropanoic acid, 3-hydroxypropionic acid, 10-hydroxystearic acid, hydroxybenzoic acid, or salicylic acid; dicarboxylic acid such as oxalic acid, malonic acid, succinic acid, adipic acid, maleic acid, or fumaric acid; and amino alcohol such as 2-aminoethanol, 2-amino-1-butanol, 2-amino-2-methyl-1-propanol, diethanolamine, or triethanolamine.

As described hereinbefore, the toner of the invention contains the resin A that is the lignin resin, a carbon-neutral biomass polymer, in the binder resin constituting the toner, thus the toner is able to feature a low environmental load with consideration for the global environmental protection.

Furthermore, among the lignin resin described above, lignosulfonic acid is preferably used as the resin A. By using lignosulfonic acid as the resin A, hydrophobic structure and a sulfonic group in the molecule act like a surfactant and allow the resin A and the resin B to be uniformly mixed, irrespective of the type of the resin B.

The lignin resin is a resin having a higher melt viscosity property, compared to polyester resins generally used as the binder resin, thus the toner containing the lignin resin in the binder resin results in a toner having a narrow fixing non-offset range and a poor fixing property. Note that, the fixing non-offset range is a temperature range capable of fixing between a minimum fixing temperature at which a low-temperature offset does not appear and a temperature at which a high-temperature offset starts to appear.

Accordingly, in the invention, in addition to the resin A that is the lignin resin, a resin B is contained in the binder resin constituting the toner so as to suppress deterioration of the fixing property caused by containing the lignin resin as the resin A.

A weight ratio of the resin A is preferably set to 20 to 50% by weight of the binder resin including the resin A and the resin B. When the ratio of the resin A that is the lignin resin in the binder resin is less than 20% by weight, a lignin-resin content is too small so that effect on global environmental protection is too small. When the ratio of the resin A that is the lignin resin in the binder resin exceeds 50% by weight, the resin B effect to suppress deterioration of the fixing property caused by containing the lignin resin is insufficient, thus the fixing property of the toner deteriorates.

As the resin B that is another component in the binder resin used in the invention, general thermoplastic resins can be used. Examples thereof include polyester resins, acrylic resins, polyurethane resins and epoxy resins. These resins may be used each alone, or two or more of them may be used in combination. Also, in resins of the same kind, two or more of resins which are different from each other in any one or plurality of physical properties including molecular weight and monomer composition may be used in combination.

The polyester resin is not particularly limited, and those which are publicly known can be used. Examples thereof include condensation polymerization products between a polybasic acid and a polyhydric alcohol. The polybasic acid as referred to herein refers to a polybasic acid or a derivative of a polybasic acid, for example, acid anhydrides or esterification products of a polybasic acid. The polyhydric alcohol as referred to herein refers to a compound containing two or more hydroxyl groups therein and includes all of alcohols and phenols.

As the polybasic acid, those which are commonly used as a monomer of a polyester resin can be used. Examples thereof include aromatic carboxylic acids such as terephthalic acid, isophthalic acid, phthalic anhydride, trimellitic anhydride, pyromellitic acid or naphthalenedicarboxylic acid; and aliphatic carboxylic acids such as maleic anhydride, fumaric acid, succinic acid or adipic acid. The polybasic acids may be used each alone, or two or more of them may be used in combination.

As the polyhydric alcohol, those which are commonly used as a monomer of a polyester resin are useful. Examples thereof include aliphatic polyhydric alcohols such as ethylene glycol, propylene glycol, butanediol, hexanediol, neopentyl glycol or glycerin; alicyclic polyhydric alcohols such as cyclohexanediol, cyclohexanedimethanol or hydrogenated bisphenol. A; and aromatic diols such as an ethylene oxide adduct of bisphenol A or a propylene oxide adduct of bisphenol A. The "bisphenol A" as referred to herein refers to 2,2-bis(p-hydroxyphenyl)propane. Examples of the ethylene oxide adduct of bisphenol A include polyoxyethylene-2,2-bis(4-hydroxyphenyl)propane. Examples of the propylene oxide adduct of bisphenol A include polyoxypropylene-2,2-bis(4-hydroxyphenyl)propane. The polyhydric alcohols may be used each alone, or two or more of them may be used in combination.

The polyester resin may be produced by the polycondensation reaction. The synthesis can be achieved by, for example, the polycondensation reaction, specifically, dehydration-condensation reaction, of polybasic acids and polyalcohols in the presence or absence of an organic solvent and in the presence of a catalyst. In this case, a part of the polybasic acids may be subjected to the de-methanol polycondensation reaction by using a methyl-esterified compound of polybasic acid. The polycondensation reaction of polybasic acids and polyalcohols may be terminated at the instant when the acid value and softening temperature of the resultant polyester stand at predetermined values. In the polycondensation reaction, by properly changing the blending ratio, reaction rate, or other conditions for the reaction, of the polybasic acids and the polyhydric alcohols, it is possible to adjust, for example, the terminal carboxyl group content of the resultant polyester resin and further to adjust the acid value of the resultant polyester, thereby allowing for adjustment of other properties such as the softening temperature.

The acrylic resin is not particularly limited, too, and those which are publicly known can be used. Examples thereof include homopolymers of an acrylic monomer and copolymers of an acrylic monomer and a vinyl based monomer. Among them, acid group-containing acrylic resins are preferable. As the acrylic monomer, those which are commonly used as a monomer of an acrylic resin can be used. Examples thereof include acrylic acid; methacrylic acid; acrylic ester based monomers such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate or dodecyl acrylate; and methacrylic ester based monomers such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate or dodecyl methacrylate. These acrylic monomers may have a substituent. Examples of the substituent-containing acrylic monomer include hydroxyl group-containing acrylic ester based or methacrylic ester based monomers such as hydroxyethyl acrylate or hydroxypropyl methacrylate. The acrylic monomers may be used each alone, or two or more of them may be used in combination. As the vinyl based monomer, those which are publicly known are useful, too. Examples thereof include aromatic vinyl monomers such as styrene or α-methylstyrene; aliphatic vinyl monomers such as vinyl bromide, vinyl chloride or vinyl acetate; and acrylonitrile based monomers such as acrylonitrile or methacrylonitrile. The vinyl based monomers may be used each alone, or two or more of them may be used in combination.

The acrylic resin can be, for example, manufactured by polymerizing one or two or more of an acrylic monomer, or one or two or more of an acrylic monomer and one or two or more of a vinyl monomer in the presence of a radical polymerization initiator by a solution polymerization method, a suspension polymerization method or an emulsion polymerization cohesion method or the like. The acid group-containing acrylic resin can be, for example, manufactured by using either one or both of an acid group or hydrophilic group-containing acrylic monomer and an acid group or hydrophilic group-containing vinyl based monomer in polymerizing an acrylic monomer or an acrylic monomer and a vinyl based monomer.

The polyurethane resin is not particularly limited, too, and those which are publicly known can be used. Examples thereof include addition polymerization products between a polyol and a polyisocyanate. Among them, acid group or basic group-containing polyurethane resins are preferable. The acid group or basic group-containing polyurethane resin can be, for example, synthesized through an addition polymerization reaction between an acid group or basic group-containing polyol and a polyisocyanate. Examples of the acid group or basic group-containing polyol include dials such as dimethylolpropionic acid or N-methyldiethanolamine; polyether polyols such as polyethylene glycol; and trihydric or polyhydric polyols such as polyester polyols, acrylic polyols or polybutadiene polyols. The polyols may be used each alone, or two or more of them may be used in combination. Examples of the polyisocyanate include tolylene diisocyanate, hexamethylene diisocyanate and isophorone diisocyanate. The polyisocyanates may be used each anole, or two or more of them may be used in combination.

The epoxy resin is not particularly limited, too, and those which are publicly known can be used. Examples thereof include a bisphenol A type epoxy resin which is synthesized from bisphenol A and epichlorohydrin; a phenol novolak type epoxy resin which is synthesized from epichlorohydrin as well as phenol novolak which is a reaction product between phenol and formaldehyde; and a cresol novolak type epoxy resin which is synthesized from epichlorohydrin as well as cresol novolak which is a reaction product between cresol and formaldehyde. Among them, acid group or basic group-containing epoxy resins are preferable. The acid group or basic group-containing epoxy resin can be, for example, manufactured by using the foregoing epoxy resin as a basis material and adding or addition polymerizing a polybasic carboxylic acid such as adipic acid or trimellitic anhydride or an amine such as dibutylamine or ethylenediamine to this epoxy resin as a basis material.

As the resin B that is another resin component in the binder resin, among the above resins, the polyester resin is preferably used for the binder resin. Since the softening temperature ($T_{1/2}$) of the polyester resin is lower than that of another resin such as the acrylic resin, the use of the polyester resin can result in a toner capable of being fixed at lower temperature, i.e., excellent in low-temperature fixing property. Moreover, the polyester resin has excellent translucency and therefore, the use of the polyester resin can result in a color toner which is excellent in chromogenic development as well as in secondary chromogenic development with a toner of another color.

Here, in a toner of the invention, a constitutional component of which is the binder resin containing a resin A that is the lignin resin and a resin B that is another thermoplastic resin, it is important to have a resin B having a specific peak top molecular weight and an acid number in order to suppress deterioration of a fixing property caused by containing the lignin resin.

The resin B in the invention is a resin having a peak top molecular weight of $10^3$ to $10^4$ and an acid number of 20 or less. When the peak top molecular weight of the resin B is less than $10^3$, resin strength of the resin B is too low to obtain sufficient resin strength even when mixing with the resin A, an effect of suppressing deterioration of a fixing property is not sufficiently obtained. When the peak top molecular weight of the resin B exceeds $10^4$, melt viscosity becomes too high to obtain a toner having a wide fixing non-offset range and an excellent fixing property. Furthermore, when an acid number of the resin B exceeds 20, melt viscosity after mixing becomes high, and it is not possible to obtain a toner having a wide fixing non-offset range and an excellent fixing property.

Note that, a peak top molecular weight is a molecular weight of a top of a peak of a molecular weight distribution curve obtained by measuring a molecular weight distribution curve using a GPC (Gel Permeation Chromatography) apparatus. Furthermore, a molecular weight distribution index (Mw/Mn) is a ratio of weight average molecular weight (Mw) to number average molecular weight (Mn) by calculating weight average molecular weight (Mw) and number average molecular weight (Mn) from the molecular weight distribution curve. Furthermore, an acid number is able to be measured by neutral titration.

Further, a glass transition temperature (Tg) of the resin B is not particularly limited and can be properly chosen over a wide range. Taking into account fixability and storage stability of the obtained toner, it is preferably 30° C. or higher and 80° C. or lower. When the glass transition temperature (Tg) of the resin B is lower than 30° C., the storage stability is insufficient so that thermal aggregation of the toner in the inside of the image forming apparatus is easy to occur. Thus, there is a possibility that development failure is generated. Also, a temperature at which the generation of a hot offset phenomenon starts (hereinafter referred to as "hot offset initiation temperature") is lowered. The "hot offset phenomenon" as referred to herein refers to a phenomenon in which in fixing a toner onto a recording medium by heating and applying a pressure with a fixing member such as a heating roller, the toner is overheated, whereby a cohesive power of toner particles is lower than an adhesive strength between the toner and the fixing member, the toner layer is divided, and a part of the toner attaches to the fixing member and is removed away. Also, when the glass transition temperature (Tg) of the resin B exceeds 80° C., fixability is lowered, and therefore, there is a possibility that fixing failure is generated.

Though the softening temperature ($T_{1/2}$) of the resin B is not particularly limited and can be properly chosen over a wide range, it is preferably 150° C. or lower, and more preferably 60° C. or higher and 120° C. or lower. When the softening temperature ($T_{1/2}$) of the resin B is lower than 60° C., storage stability of the toner is lowered; thermal aggregation of the toner in the inside of the image forming apparatus is easy to occur; and the toner cannot be stably supplied into an image bearing member. Thus, there is a possibility that development failure is generated. Also, there is a possibility that a fault of the image forming apparatus is induced. When the softening temperature ($T_{1/2}$) of the resin B exceeds 120° C., since the binder resin is hardly melted in the melt-kneading step, kneading of the respective raw materials of the toner is difficult. Thus, there is a possibility that dispersibility of a colorant, a release agent, a charge control agent and the like in the melt-kneaded material is lowered. Also, in fixing the toner onto the recording medium, the toner is hardly melted or softened, and therefore, fixability of the toner to a medium (recording medium) is lowered. Thus, there is a possibility that fixing failure is generated.

A glass transition temperature and a softening temperature of the resin B in the invention may be selected as appropriate by a combination with the resin A.

Examples of the colorant include dyes and pigments. Among them, pigments are preferably used. Since pigments are more excellent in light fastness and color forming properties than dyes, the use of a pigment makes it possible to obtain a toner having excellent light fastness and color forming properties. As described below, specific examples of the colorant include colorants for yellow toner, colorants for magenta toner, colorants for cyan toner and colorants for black toner. In the following, a color index is abbreviated as "C.I."

Examples of the colorant for yellow toner include an azo pigment such as C.I. Pigment Yellow 1, C.I. Pigment Yellow 5, C.I. Pigment Yellow 12, C.I. Pigment Yellow 15 and C.I. Pigment Yellow 17, an inorganic pigment such as a yellow iron oxide and an ocher, a nitro dye such as C.I. Acid Yellow 1, and an oil soluble dye such as C.I. Solvent Yellow 2, C.I. Solvent Yellow 6, C.I. Solvent Yellow 14, C.I. Solvent Yellow 15, C.I. Solvent Yellow 19 and C.I. Solvent Yellow 21, each of which is classified depending upon the color index.

Examples of the colorant for magenta toner include C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10 and C.I. Disperse Red 15, each of which is classified depending upon the color index.

Examples of the colorant for cyan toner include C.I. Pigment Blue 15, C.I. Pigment Blue 16, C.I. Solvent Blue 55, C.I. Solvent Blue 70, C.I. Direct Blue 25 and C.I. Direct Blue 86, each of which is classified depending upon the color index.

Examples of the colorant for black toner include carbon blacks such as channel black, roller black, disc black, gas furnace black, oil furnace black, thermal black or acetylene black. An appropriate carbon black may be properly chosen among these various carbon blacks depending upon design properties of the toner to be obtained.

Other than these pigments, bright red pigments, green pigments and the like can be used. The colorants may be used each alone, or two or more thereof may be used in combination. Also, two or more of the same color system may be used, and one or two or more of each of different color systems can be used, too.

The colorant is preferably used in a form of a master batch. The master batch of the colorant can be, for example, manufactured by kneading a melt of a synthetic resin and a colorant. As the synthetic resin, a resin of the same kind as in the binder resin of the toner or a resin having good compatibility with the binder resin of the toner can be used. Though a use proportion of the synthetic resin and the colorant is not particularly limited, a proportion of the colorant is preferably 30 parts by weight to 100 parts by weight based on 100 parts by weight of the synthetic resin. The master batch is, for example, granulated into a particle size of from about 2 mm to 3 mm and then used.

Though the content of the colorant in the toner of the invention is not particularly limited, it is preferably 4 parts by weight to 20 parts by weight based on 100 parts by weight of the binder resin. When the content of the colorant is a value falling within the foregoing range, it is possible to obtain a toner with high tinting strength while suppressing a filler effect due to the addition of the colorant. When the content of the colorant exceeds 20 parts by weight, elasticity increases due to the filler effect of the colorant, and thus, there is a possibility that fixability of the toner is lowered.

These colorants may be used each alone, or two or more of colorants of different colors may be used in combination. Furthermore, a plurality of colorants of the same color system may be also used in combination. In the case of using a masterbatch, it is preferable to adjust the used amount of masterbatch so that content of colorant in a toner of the invention is within the range. It is possible to form an image having sufficient image density, a high coloring property and favorable image quality by using colorant in the range.

The release agent is added for the purpose of imparting release properties to the toner in fixing the toner onto a recording medium. Accordingly, in comparison with the case of not using a release agent, it is possible to increase the hot offset initiation temperature and to enhance the hot offset resistance. Furthermore, by heating in fixing the toner, it is possible to melt the release agent, lower a fixing initiation temperature, and enhance the low-temperature fixability.

As the release agent, those which are commonly used in this field can be used. Examples thereof include waxes. Examples of the wax include natural waxes such as paraffin wax, carnauba wax or rice wax; synthetic waxes such as polypropylene wax, polyethylene wax or Fischer-Tropsch wax; coal based waxes such as montan wax; petroleum based waxes; alcohol based waxes; and ester based waxes.

The release agents may be used each alone, or two or more of them may be used in combination. A blending amount of the release agent is not particularly limited and can be properly chosen over a wide range depending upon various conditions such as the kinds and contents of other components including the binder resin and the colorant or properties which are required for the toner to be prepared. The blending amount of the release agent is preferably 3 parts by weight to 10 parts by weight based on 100 parts by weight of the binder resin. When the blending amount of the release agent is less than 3 parts by weight, there is a possibility that an effect for enhancing low-temperature fixability and hot offset resistance is not sufficiently revealed. When the blending amount of the release agent exceeds 10 parts by weight, dispersibility of the release agent in the melt-kneaded material is lowered, and thus, there is a possibility that a toner having a fixed performance cannot be stably obtained. Also, there is a possibility that a phenomenon called filming, in which the toner is fused in a film form on the surface of an image bearing member such as a photoreceptor, is easily generated.

A melting temperature (Tm) of the release agent is preferably 50° C. to 150° C. and more preferably 80° C. or less. The release agent having a melting temperature less than 50° C. may be molten and cause toner matrix particle-to-particle aggregation inside a developing device or may cause a failure such as the toner filming on a surface of a photoreceptor. The release agent having a melting temperature exceeding 150° C. may not be able to sufficiently elute when the toner is fixed to a recording medium, possibly causing a failure to exert a sufficient effect of enhancing the anti-high-temperature offset property. The melting temperature of the release agent represents a temperature at an endothermic peak corresponding to meltdown of the DSC curve obtained through measurement of differential scanning calorimetry (abbreviated as "DSC").

The toner of the invention may contain other toner additive components such as a charge control agent in addition to the binder resin, the colorant and the release agent. When the toner contains a charge control agent, it is possible to impart favorable charging properties to the toner. As the charge control agent, a charge control agent for positive charge control or negative charge control can be used. Examples thereof include charge control agents for positive charge control such as basic dyes, quaternary ammonium salts, quaternary phosphonium salts, aminopyrine, pyrimidine compounds, polynuclear polyamino compounds, aminosilane, nigrosine dyes and derivatives thereof, triphenylmethane derivatives, guanidine salts or amidine salts; and charge control agents for negative charge control such as oil-soluble dyes (for example, oil black, spiron black, or the like), metal-containing azo compounds, azo complex dyes, metal naphthenate salts, salicylic acid and metal complexes and metal salts of derivatives thereof (examples of the metal include chromium, zinc and zirconium), boron compounds, fatty acid soaps, long-chain alkyl carboxylates or resin acid soaps. The charge control agents may be used each alone, or two or more of them may be used in combination. A use amount of the compatible charge control agent is preferably 0.5 parts by weight to 5 parts by weight based on 100 parts by weight of the binder resin, and more preferably 0.5 parts by weight or more and 3 parts by weight or less based on 100 parts by weight of the binder resin. When the charge control agent is contained in an amount exceeding 5 parts by weight, the carrier is contaminated, and thus, there is a possibility that flying of the toner is generated. When the charge control agent is contained in an amount of less than 0.5 parts by weight, there is a possibility that sufficient charging properties cannot be imparted to the toner.

In the color toner, it is desirable to use a colorless charge control agent. And, it is desirable to use salicylic acid and a metal complex or a metal salt of a derivative thereof.

FIG. 1 is a flowchart for showing a method for manufacturing a toner according to the invention. The method for manufacturing a toner of this embodiment includes a pre-mixing step (step s1) of mixing at least a binder resin, a colorant, a release agent, and other toner adding components such as a charge control agent, when necessary to prepare a mixture, a melt-kneading step (step s2) of melt-kneading the mixture to prepare a melt-kneaded material, a pulverizing step (step s3) of pulverizing the melt-kneaded material to prepare a pulverized material, and a classifying step (step s4) of removing excessively pulverized material and coarse particles from the pulverized material.

[Pre-Mixing Step]

At the pre-mixing step at step s1, at least a binder resin, a colorant and a release agent, and other toner additive components such as a charge control agent, when necessary, are dry-mixed by a mixer. As a mixer for dry-mixing, the known mixer is usable and examples thereof include Henschel-type mixing apparatuses such as a Henschel mixer (trade name: FM mixer, manufactured by Mitsui Mining Co., Ltd.), SUPERMIXER (trade name, manufactured by Kawata MFG Co., Ltd.), and MECHANOMIL (trade name, manufactured by Okada Seiko Co., Ltd.), and ANGMIL (trade name, manufactured by Hosokawa Micron Corporation), HYBRIDIZATION SYSTEM (trade name, manufactured by Nara Machinery Co., Ltd.) and COSMOSYSTEM (trade name, manufactured by Kawasaki Heavy Industries, Ltd.)

[Melt-Kneading Step]

At the melt-kneading step at step s2, the mixture prepared at the pre-mixing step is melt-kneaded to prepare melt-kneaded material. Melt-kneading of the mixture is performed by heating to a temperature of a softening temperature of the resin A and the resin B in the binder resin or more, and less than a thermal decomposition temperature thereof, to melt or soften the resin. A and the resin B, and disperse a toner material other than the binder resin in the binder resin.

As a kneading machine to be used for melt-kneading, those which are publicly known can be used. For example, general kneading machines such as a kneader, a twin-screw extruder, a two-roller mill, a three-roller mill or a laboplast mill can be used. As a kneader like this, there are exemplified single screw or twin-screw extruders such as TEM-100B (a trade name, manufactured by Toshiba Machine Co., Ltd.), or PCM-65/87 or PCM-30 (all of which are a trade name, manufactured by Ikegai, Ltd.); and open roll type kneading machines such as MOS 320-1800 or KNEADEX (all of which are a trade name, manufactured by Mitsui Mining Co., Ltd.).

Among them, the open roll type continuous kneading machine is preferably used. The open roll type consecutive kneading machine supplies the toner material mixture obtained at the pre-mixing step from on a heating roll on one side end of an open roll by a material feeding and supplying apparatus consisting of a screw feeder, a vibration feeder, and the like. The supplied toner material mixture remains on one end supply side between both open rolls and is melted. Due to the melted binder resin and the like, a bank is formed, and where rotation of the open roll engulfs the toner material mixture supplied into the bank, forming a convective flow.

Furthermore, at the bank, the toner mixed material engulfed by the convective flow is melted by heating and rotation of the open roll, causing the binder resin to be fluid having viscosity. Then, the melted toner material mixture sticks around a surface of the open roll of the heating roller, and while being transported to the other end side (an end section side opposite to a supplying side), the toner material mixture is kneaded to prepare kneaded material.

Then, at the open roll, melt-kneading of the toner material mixture is performed at a low temperature usually so that melting of the resin A and the resin B in the binder resin does not proceed, and then the binder resin that is highly viscose fluid is kneaded to generate great compressing force and shear force. A pigment and an additive are finely granulated due to the compressing force and shear force, uniformly dispersed in the binder resin, and the toner material mixture is melt-kneaded to prepare the melt-kneaded material, that is discharged from the other end discharging side, cooled and solidified. Furthermore, the toner material mixture may be melt-kneaded by using a plurality of kneading machines.

In the melt-kneaded material obtained at the melt-kneading step, it is preferable that a loss elastic modulus G2 at 120° C. is $10^5$ Pa or less, and the loss elastic modulus G2 at 200° C. is $10^1$ Pa or more, and a loss tangent (tan δ) that is a value of dividing the loss elastic modulus G2 at 200° C. by a storage elastic modulus G1 is 10 or less. That is, a toner of the invention, comprising the melt-kneaded material preferably has the viscoelastic property. This enables a toner to have sufficiently wide fixing non-offset range that is a temperature range capable of fixing between a minimum fixing temperature at which a low-temperature offset does not appear and a temperature at which a high-temperature offset starts to appear.

When the loss elastic modulus G2 of the melt-kneaded material at 120° C. exceeds $10^5$ Pa, viscosity of the toner that is prepared becomes too high, lowering a low-temperature fixing property. Furthermore, when the loss elastic modulus G2 of the melt-kneaded material at 200° C. is less than $10^1$ Pa, and the loss tangent (tan δ) exceeds 10, elasticity of the toner that is prepared becomes too low, lowering an anti-high-temperature offset property.

To obtain melt-kneaded material having the viscoelastic property, a mixing ratio of the resin A in the binder resin, a peak top molecular weight of the resin B, an acid number, a softening temperature, a glass transition temperature, and the like may be adjusted as appropriate.

Note that, the storage elastic modulus G1 is a value showing elasticity of the melt-kneaded material and the loss elastic modulus G2 is a value showing viscosity of the melt-kneaded material. The loss tangent (tan δ) that is a ratio between the storage elastic modulus G1 and the loss elastic modulus G2, is a value of dividing the loss elastic modulus G2 by the storage elastic modulus G1, representing a rate of viscosity to elasticity. Usually, the storage elastic modulus G1 and the loss elastic modulus G2 of a resin with a high melting property, such as a binder resin contained in the melt-kneaded material, are highly dependent on temperature, therefore, in the invention, the storage elastic modulus G1 and the loss elastic modulus G2 were measured by vibrating the kneaded material in a melted states while changing a temperature under a fixed condition such that frequency is 1.0 Hz and a distortion ratio is 5%. Then, from the obtained measurement result, a loss elastic modulus—temperature property curve showing a relation between the loss elastic modulus G2 and the temperature, and a loss tangent—temperature property curve representing a relation between the loss tangent (tan δ) and the temperature were obtained, and from graphs thereof, values of the loss elastic modulus G2 at 120° C. and 200° C. and the loss tangent (tan δ) at 200° C. were obtained. Note that, a temperature condition at the melt-kneading step is preferably around 120 to 200° C. that is a temperature range of a softening temperature of the resin A and the resin B in the binder resin or more and less than a decomposition temperature thereof, therefore the storage elastic modulus G1, the loss elastic modulus G2, and the loss tangent (tan δ) in the temperature range were obtained.

[Pulverizing Step]

In the pulverizing step of Step s3, the melt-kneaded material obtained in the melt-kneading step is cooled for solidification and then pulverized to prepare a pulverized material. That is, the melt-kneaded material which has been cooled for solidification is first coarsely pulverized into a coarsely pulverized material having, for example, a volume average particle size of 100 μm or more and 5 mm or less by a hammer mill, a cutting mill or the like. Thereafter, the obtained coarsely pulverized material is finely pulverized into a pulverized material having, for example, a volume average particle size of 15 μm or less. For fine pulverization of the coarsely pulverized material, for example, a jet pulverizer for achieving pulverization utilizing an ultrasonic jet stream, an impact pulverizer for achieving pulverization by introducing a coarsely pulverized material into a space to be formed between a rotator (rotor) rotating at a high speed and a stator (liner) or the like can be used.

Further, the melt-kneaded material which has been cooled for solidification may be directly pulverized by a jet pulverizer, an impact pulverizer or the like without going through coarse pulverization by a hammer mill, a cutting mill or the like.

[Classifying Step]

In the classifying step of Step s4, an excessively-pulverized toner particle or a coarse toner particle are removed from the pulverized material which has been prepared in the pulverizing step by using a classifier. The excessively-pulverized toner particle or the coarse toner particle can also be recovered and used for the purpose of reusing it for manufacturing other toner.

For the classification, a known classifying machine capable of removing excessively pulverized toner particles and coarse toner particles by classification with a centrifugal force or classification with a wind force is usable and an example thereof includes a jet pulverizing machine that performs pulverization using ultrasonic jet air stream, and an impact pulverizing machine that performs pulverization by guiding coarsely pulverized material to a space formed between a rotor that is rotated at high speed and a stator (liner).

The classification is preferably carried out by properly regulating a classification condition such that the toner particle obtained after the classification has a volume average particle size of 3 to 15 μm. In particular, for the purpose of obtaining an image with high image quality, it is preferable to regulate the toner particle so as to have a volume average particle size of 3 to 9 μm; and for the purpose of further improving the image quality, it is preferable to regulate the toner particle so as to have a volume average particle size of 5 to 8 μm. When the volume average particle size of the toner particle is less than 3 μm, the particle size of the toner becomes excessively small so that there is a possibility that high electrification and low fluidization occur. When such high electrification and low fluidization are generated, the toner cannot be stably supplied into a photoreceptor which is an image bearing member, and thus, there is a possibility that background fogging and a reduction of the image density are generated. When the volume average particle size of the toner particle exceeds 15 μm, the particle size of the toner is too large to obtain an image with high resolution. Also, because of the matter that the particle size of the toner is large, a specific surface area is decreased, and the quantity of charging of the toner becomes low. When the quantity of charging of the toner is low, the toner is not stably supplied into the photoreceptor, and thus, there is a possibility that contamination within the machine is generated due to flying of the toner.

The thus manufactured toner particle may be mixed with, for example, an external additive bearing a function such as enhancement in powder fluidity, enhancement in triboelectrostatic properties, enhancement in heat resistance, improvement in low-term storage properties, improvement in cleaning properties or control of abrasion properties on the surface of a photoreceptor. As the external additive, those which are commonly used in this field can be used. Examples thereof include a silica fine powder, a titanium oxide fine powder and an alumina fine powder. Such an inorganic fine powder is preferably treated with a treating agent for the purpose of hydrophobilization, control of charging properties and the like, such as a silicone varnish, a modified silicone varnish of every sort, a silicone oil, a modified silicone oil of every sort, a silane coupling agent, a functional group-containing silane coupling agent or other organosilicon compound. The external additives may be used each alone, or two or more of them may be used in combination. Taking into account the quantity of charging necessary for the toner, influences against abrasion of the photoreceptor due to the addition of an external additive, environmental properties of the toner and the like, the addition amount of the external additive is favorably 5 parts by weight or less based on 100 parts by weight of the toner particle.

The external additive preferably has a number average particle size of primary particles of from 10 nm to 500 nm. By using an external additive having such a particle size, an effect for enhancing fluidity of the toner is much more easily revealed.

As described previously, the toner of the invention, in which an external additive is externally added in the toner particle as the need arises can be used as a one-component developer as it stands. Also, it can be used as a two-component developer upon being mixed with a carrier.

A two-component developer of the invention includes the toner mentioned above and a carrier. Therefore, the two-component developer with a low environmental load, taking global environmental protection into account, and having an excellent fixing property, is obtainable. Furthermore, the two-component developer of the invention includes a toner of the invention in which charging of individual toner particle is appropriately charged, therefore and a high-quality image in which a fog to a non-image region does not occur is able to be achieved.

For the carrier, magnetic particles can be used. Specific examples of the magnetic particles include metals such as iron, ferrite, and magnetite; and alloys composed of the metals just cited and metals such as aluminum or lead. Among these examples, ferrite is preferred.

Further, the carrier can be a resin-coated carrier in which the magnetic particles are coated with a resin, or a dispersed-in-resin carrier in which the magnetic particles are dispersed in a resin. The resin for coating the magnetic particles includes, but is not particularly limited to, for example, an olefin-based resin, a styrene-based resin, a styrene-acrylic resin, a silicone-based resin, an ester-based resin, and a fluorine-containing polymer-based resin. The resin used for the dispersed-in-resin carrier includes, but is not particularly limited either to, for example, a styrene-acrylic resin, a polyester resin, a fluorine-based resin, and a phenol resin.

A shape of the carrier is preferably spherical or oblong. Further, the volume average particle size of the carrier is not particularly limited, and in consideration of enhancement in image quality, it is preferably 10 μm to 100 μm and more preferably 50 μm or less. In this way, by setting the volume average particle size of the carrier to be 50 μm or less, the toner and the carrier come into contact with each other more frequently, and even each toner with smaller particle size can be charged and controlled properly, thereby allowing for formation of a high-quality image having no fog occurring on the non-image region.

Furthermore, resistivity of the carrier is preferably $10^8\Omega\cdot$cm or more and more preferably $10^{12}\Omega\cdot$cm or more. The resistivity of the carrier is a value derived from a current value obtained in a manner that the carrier is put in a container having a sectional area of 0.50 $cm^2$ followed by tapping, and a load of 1 $kg/cm^2$ is then applied to the particles put in the container, thereafter being subjected to application of voltage which generates an electric field of 1,000 V/cm between the load and a bottom electrode. When the resistivity of the carrier is small, application of bias voltage to a developing sleeve will cause the charge to be injected to the carrier, which makes the carrier particles be easily attached to the photoreceptor. Further, in this case, breakdown of the bias voltage occurs more easily.

Magnetization intensity (maximum magnetization) of the carrier is preferably 10 emu/g to 60 emu/g and more preferably 15 emu/g to 40 emu/g. The magnetization intensity depends on magnetic flux density of the developing roller, however, under a condition that the developing roller has normal magnetic flux density, the magnetization intensity less than 10 emu/g will lead to a failure to exercise magnetic binding force, which may cause the carrier to be spattered. When the magnetization intensity exceeds 60 emu/g, it becomes difficult to keep a noncontact state with an image bearing member in a noncontact development where brush of the carrier is too high. Further, in a contact development, sweeping patterns may appear more frequently in a toner image.

A use ratio between the toner and the carrier contained in the two-component developer is not particularly limited and may be appropriately selected according to kinds of the toner and the carrier. To take the case of the resin-coated carrier (having density of 5 $g/cm^2$ to 8 $g/cm^2$) as an example, it is preferable to use the toner in such an amount that the content of the toner in the two-component developer is 2% by weight to 30% by weight, and more preferably 2% by weight to 20% by weight, of a total amount of developer. Further, in the two-component developer, the coverage of the toner over the carrier is preferably 40% to 80%.

Figure 2:
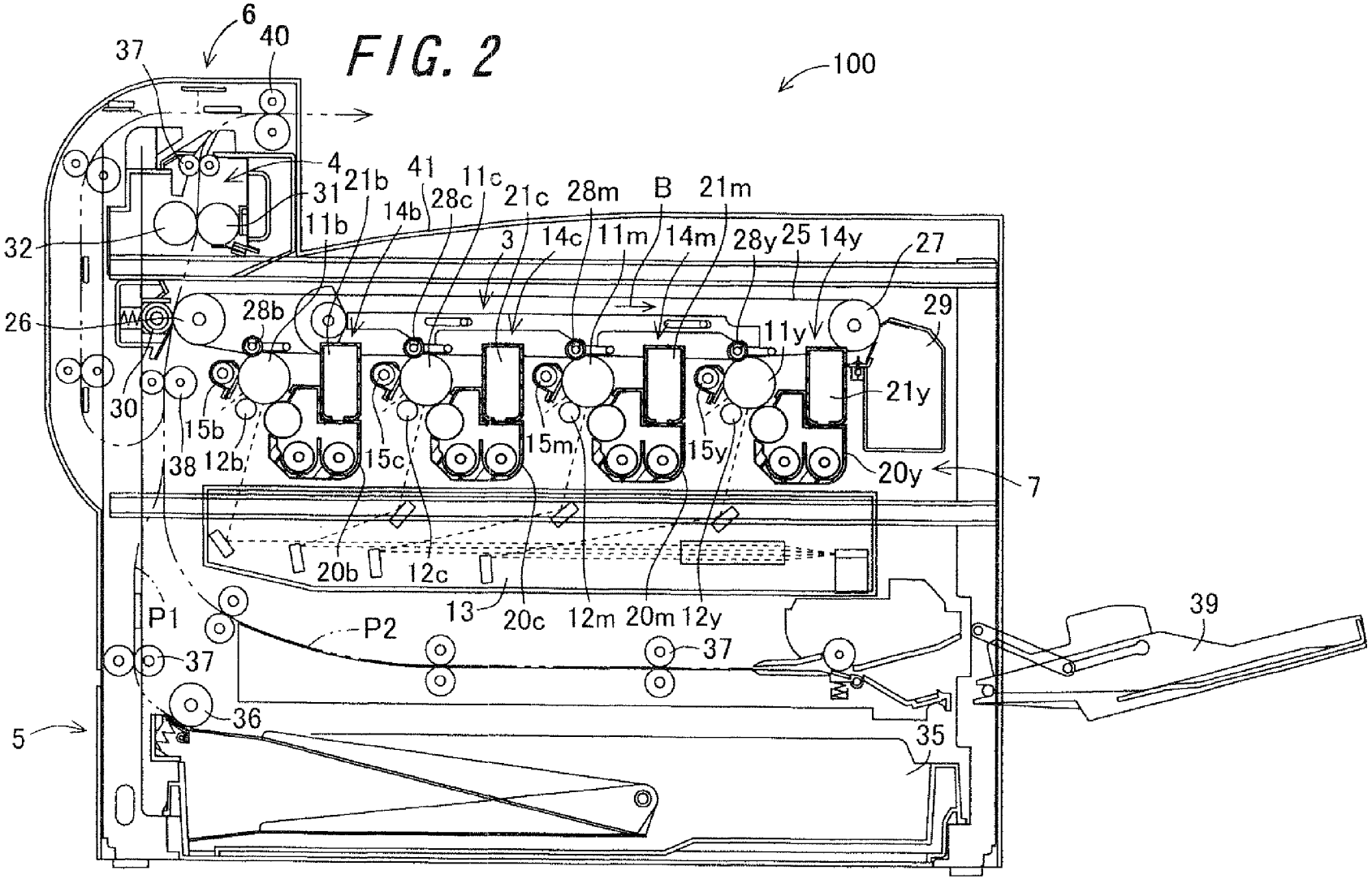
FIG. 2 is a diagram showing a configuration of an image forming apparatus according to an embodiment of the invention.

FIG. 2 is a diagram showing a configuration of an image forming apparatus 100 that is an embodiment of the invention. The image forming apparatus 100 includes a developing device 14 for performing development using the above two-component developer. Therefore, it is possible to form a high-quality toner image on a photoreceptor drum 11 that is a latent image bearing member by the developing device 14 capable of forming a toner image consisting of a toner having an excellent fixing property and storage stability in a state where an environmental load is low and global environmental protection is taken into account, and form a high-quality image stably without occurrence of a trouble of fixing failure over a long term.

The image forming apparatus 100 is a multifunctional peripheral having a copier function, a printer function, and a facsimile function together, and according to image information being conveyed to the image forming apparatus 100, a full-color or monochrome image is formed on a recording medium. That is, the image forming apparatus 100 has three types of print mode, i.e., a copier mode, a printer mode and a FAX mode, and the print mode is selected by a control unit (not shown) in accordance with, for example, the operation input from an operation portion (not shown) and reception of the printing job from external equipment such as a personal computer, a mobile device, an information recording storage medium, and a memory device. The image forming apparatus 100 includes an image forming section 7, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the image forming section 7 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The toner image forming section 7 includes a photoreceptor drum 11, a charging section 12, an exposure unit 13, a developing device 14, and a cleaning unit 15. The charging section 12, the developing device 14, and the cleaning unit 15 are disposed around the photoreceptor drum 11 in a rotational direction in the order just stated. The charging section 12 is disposed vertically below the developing device 14 and the cleaning unit 15.

The photoreceptor drum 11 is rotatably supported around an axis thereof by a driving section (not shown) and includes a conductive substrate (not shown) and a photosensitive layer (not shown) formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, or the like, is formed on a film-like substrate such as a synthetic resin film, a metal film, and paper; and a resin composition containing at least conductive particles and/or conductive polymers. As the film-like substrate used for the conductive film, a synthetic resin film is preferred and a polyester film is particularly preferred. Further, as the method of forming the conductive layer in the conductive film, vapor deposition, coating, or the like, is preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the charging property of the photosensitive layer can be enhanced under a low temperature circumstance and/or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charge under irradiation of light, and optionally contains known binder resin, plasticizer, sensitizer, and the like. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton.

Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably 5 parts by weight to 500 parts by weight and more preferably 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone or, optionally, two or more of them may be used in combination.

The charge generating layer can be formed by dissolving or dispersing an appropriate amount of a charge generating substance, a binder resin and, optionally, a plasticizer, a sensitizer, and the like, respectively in an appropriate organic solvent in which the ingredients described above are dissolvable or dispersible, to thereby prepare a coating solution for charge generating layer, and then applying the coating solution for charge generating layer to the surface of the conductive substrate, followed by drying. The thickness of the charge generating layer obtained in this way is not particularly limited, and preferably 0.05 μm to 5 μm and more preferably 0.1 μm to 2.5 μm.

The charge transporting layer stacked over the charge generating layer contains as essential ingredients a charge transporting substance having an ability of receiving and transporting the charge generated from the charge generating substance, and a binder resin for charge transporting layer, and optionally contains known antioxidant, plasticizer, sensitizer, lubricant, and the like. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone.

The charge transporting substances may be used each alone, or two or more of them may be used in combination. The content of the charge transporting substance is not particularly limited, and preferably 10 parts by weight to 300 parts by weight and more preferably 30 parts by weight to 150 parts by weight based on 100 parts by weight of the binder resin in the charge transporting substance. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, an epoxy resin, polyurethane, polyvinylketone, polystyrene, polyacrylamide, a phenolic resin, a phenoxy resin, a polysulfone resin, and a copolymer resin thereof. Among those materials, in view of the film forming property, the wear resistance, an electrical property and the like of the obtained charge transporting layer, it is preferable to use, for example, polycarbonate which contains bisphenol Z as the monomer ingredient (hereinafter referred to as "bisphenol polycarbonate"), and a mixture of bisphenol polycarbonate and other polycarbonate. The binder resins may be used each alone, or two or more of them may be used in combination.

The charge transporting layer preferably contains an antioxidant together with the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane, and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer. The charge transporting layer can be formed by dissolving or dispersing an appropriate amount of a charge transporting substance, a binder resin and, optionally, an antioxidant, a plasticizer, a sensitizer, and the like respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying.

The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kinds and contents of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 when viewed in a longitudinal direction of the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, or the like. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum 12. It is also possible to use a contact-charging type charger such as a charging brush or a magnetic brush.

The exposure unit 13 is disposed so that light beams corresponding to each color information emitted from the exposure unit 13 pass between the charging section 12 and the developing device 14 and reach the surface of the photoreceptor drum 11. In the exposure unit 13, the image information is converted into light beams corresponding to each color information of black (b), cyan (c), magenta (m), and yellow (y), and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use, for example, a laser scanning unit having a laser-emit portion and a plurality of reflecting mirrors. The other usable examples of the exposure unit 13 may include an LED (Light Emitting Diode) array and a unit in which a liquid-crystal shutter and a light source are appropriately combined with each other.

Figure 3:
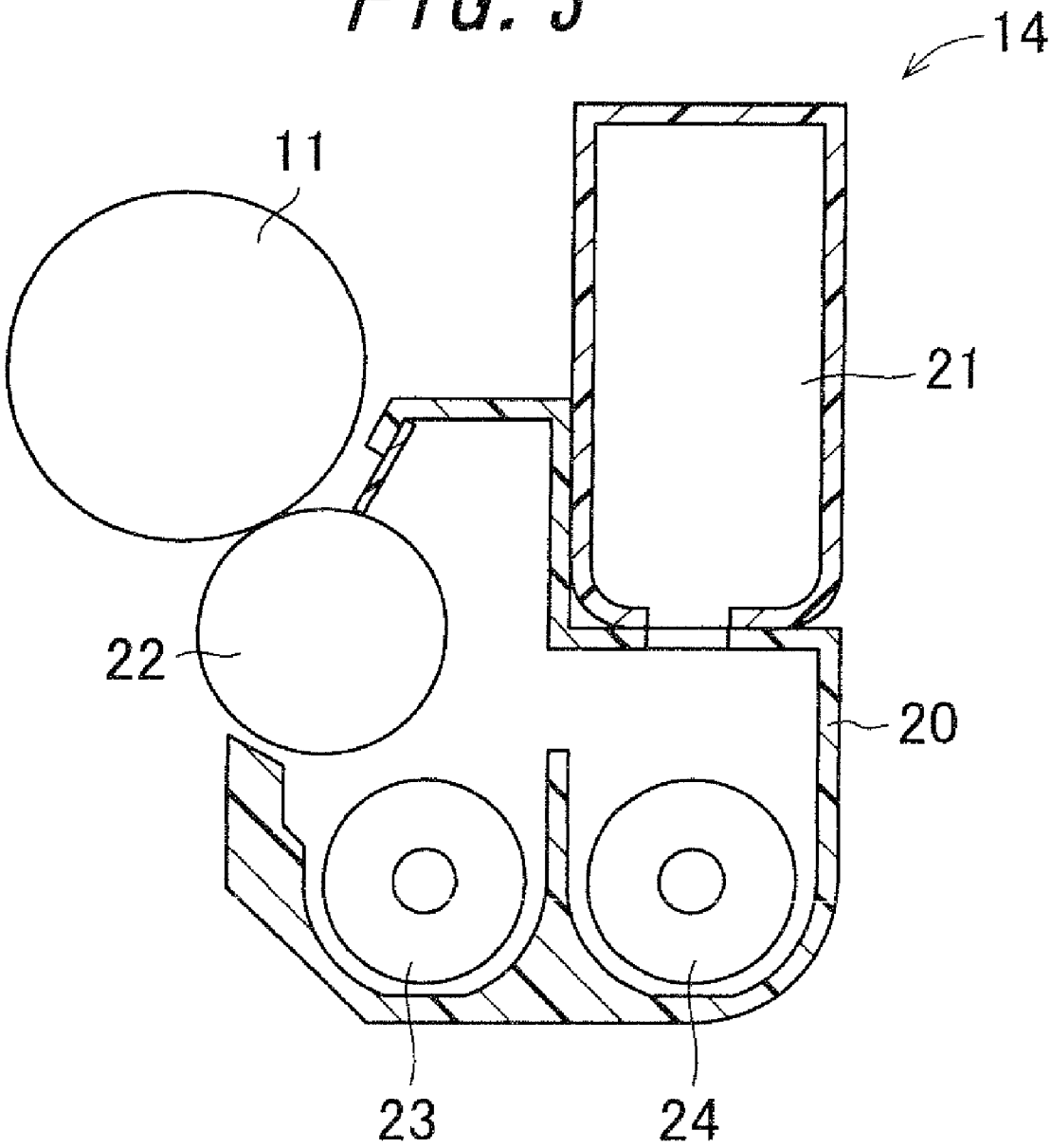
FIG. 3 is a diagram showing a configuration of a developing device of the invention.

FIG. 3 is a diagram showing a configuration of the developing device 14 according to the invention. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller 22, a supplying roller 23, and an agitating roller 24, or screw members, which roller or screw members are contained in the developing tank 20. The developing tank 20 has an opening in a side face thereof toward the photoreceptor drum 11 and the developing roller 22 is rotatably provided in a position opposed to the photoreceptor drum 11 through the opening. The developing roller 22 is rotatably provided at such a position as to face the photoreceptor drum 11 through the opening just stated.

The developing roller 22 is a roller-shaped member for supplying a toner to the electrostatic latent image on the surface of the photoreceptor drum 11 in a pressure-contact region or most-adjacent region between the developing roller 22 and the photoreceptor drum 11. In supplying the toner, to a surface of the developing roller 22 is applied potential whose polarity is opposite to polarity of the potential of the charged toner, which serves as development bias voltage. By so doing, the toner on the surface of the developing roller 22 is smoothly supplied to the electrostatic latent image. Furthermore, an amount of the toner being supplied to the electrostatic latent image (which amount is referred to as "toner attachment amount") can be controlled by changing a value of the development bias voltage.

The supplying roller 23 is a roller-shaped member which is rotatably disposed so as to face the developing roller 22 and used to supply the toner to the vicinity of the developing roller 22. The agitating roller 24 is a roller-shaped member which is rotatably disposed so as to face the supplying roller 23 and used to feed to the vicinity of the supplying roller 23 the toner which is newly supplied from the toner hopper 21 into the developing tank 20. The toner hopper 21 is disposed so as to communicate a toner replenishment port (not shown) formed in a vertically lower part of the toner hopper 21, with a toner reception port (not shown) formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus 100 of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of a charging device. The degraded surface part is, however, worn away by abrasion through the cleaning unit 15 and thus removed reliably, though gradually. Accordingly, the problem of the surface degradation caused by the ozone, or the like, is actually solved, and the potential of charge given in the charging operation can be thus maintained stably for a long period of time. Although the cleaning unit 15 is provided in the embodiment, no limitation is imposed on the configuration and the cleaning unit 15 does not have to be provided.

In the toner image forming section 7, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of the toner image forming operations just described is repeatedly carried out.

The transfer section 3 is disposed above the photoreceptor drum 11 and includes the intermediate transfer belt 25, a driving roller 26, a driven roller 27, intermediate transferring rollers 28(*b, c, m, y*), a transfer belt cleaning unit 29, and a transfer roller 30. The intermediate transfer belt 25 is an endless belt supported around the driving roller 26 and the driven roller 27 with tension, thereby forming a loop-shaped travel path. The intermediate transfer belt 25 rotates in an arrow B direction. When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 with the intermediate transfer belt 25 interposed therebetween, with the result that the toner image formed on the surface of the photoreceptor drum 11 is transferred onto the intermediate transfer belt 25.

In the case of a multicolor image, the toner images of respective colors formed on the respective photoreceptor drums 11 are sequentially transferred and overlaid onto the intermediate transfer belt 25, thus forming a multicolor toner image. The driving roller 26 can rotate around an axis thereof with the aid of a driving section (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 with the intermediate transfer belt 25 interposed therebetween, and capable of rotating around its own axis by a driving section (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25.

The transfer belt cleaning unit 29 is disposed opposite to the driven roller 27 with the intermediate transfer belt 25 interposed therebetween so as to come into contact with an outer circumferential surface of the intermediate transfer belt 25. The residual toner which is attached to the intermediate transfer belt 25, which is caused by contact of the intermediate transfer belt 25 with the photoreceptor drum 11, may cause contamination on a reverse side of the recording medium, the transfer belt cleaning unit 29 removes and collects the toner on the surface of the intermediate transfer belt 25. The transfer roller 30 is disposed in pressure-contact with the driving roller 26 with the intermediate transfer belt 25 interposed therebetween, and capable of rotating around its own axis by a driving section (not shown). In a pressure-contact region (a transfer nip region) between the transfer roller 30 and the driving roller 26, a toner image which has been carried by the intermediate transfer belt 25 and thereby conveyed to the pressure-contact region is transferred onto a recording medium fed from the later-described recording medium feeding section 5. The recording medium bearing the toner image is fed to the fixing section 4. In the transfer section 3, the toner image is transferred from the photoreceptor drum 11 onto the intermediate transfer belt 25 in the pressure-contact region between the photoreceptor drum 11 and the intermediate transferring roller 28, and by the intermediate transfer belt 25 rotating in the arrow B direction, the transferred toner image is conveyed to the transfer nip region where the toner image is transferred onto the recording medium.

The fixing section 4 is provided downstream of the transfer section 3 along a conveyance direction of the recording medium, and contains a fixing roller 31 and a pressure roller 32. The fixing roller 31 can rotate by a driving section (not shown), and heats the toner constituting an unfixed toner image borne on the recording medium so that the toner is fused. Inside the fixing roller 31 is provided a heating portion (not shown). The heating portion heats the heating roller 31 so that a surface of the heating roller 31 has a predetermined temperature (which may also be hereinafter referred to as "heating temperature"). For the heating portion, a heater, a halogen lamp, and the like device can be used, for example. The heating portion is controlled by a fixing condition controlling portion.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotate by the rotational drive of the fixing roller 31. The pressure roller 32 fixes the toner image onto the recording medium in cooperation with the fixing roller 31. At this time, the pressure roller 32 assists in the fixation of the toner image onto the recording medium by pressing the toner in fused state due to the heat of the fixing roller 31 against the recording medium. A pressure-contact region between the fixing roller 31 and the pressure roller 32 is a fixing nip region. In the fixing section 4, the recording medium onto which the toner image has been transferred in the transfer section 3 is nipped by the fixing roller 31 and the pressure roller 32 so that when the recording medium passes through the fixing nip region, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path P1. The conveying rollers 37 are a pair of roller members disposed in pressure-contact with each other, and convey the recording medium for the registration rollers 38.

The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region. The manual paper feed tray 39 is a device for taking the recording mediums into the image forming apparatus 100, and recording mediums stored in the manual paper feed tray 39 are different from the recording mediums stored in the automatic paper feed tray 35 and have any size. The recording medium taken in from the manual paper feed tray 39 passes through a paper conveyance path P2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The discharging section 6 includes the conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 100. The catch tray 41 stores the recording medium onto which the image has been fixed.

The image forming apparatus 100 includes a control unit (not shown). The control unit is disposed, for example, in an upper part of an internal space of the image forming apparatus, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) and the like which are disposed in various portions inside the image forming apparatus 100, and image information obtained from external devices. Further, pro rams for operating various functional elements are written. Examples of the various functional elements include a recording medium determining section, an attachment amount controlling section, and a fixing condition controlling section. For the memory portion, those conventionally used in the relevant fields can be used including, for example, a read only memory (ROM), a random access memory (RAM), and a hard disc drive (HOD).

For the external equipment, it is possible to use electrical and electronic devices which can form or obtain the image information and which can be electrically connected to the image forming apparatus 100. Examples of the external equipment include a computer, a digital camera, a television set, a video recorder, a DVD (digital versatile disc) recorder, an HD DVD (high-definition digital versatile disc), a flu-ray disc recorder, a facsimile machine, and a mobile terminal device. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is realized by a microcomputer, a microprocessor or the like having a central processing unit (abbreviated as CPU). The control unit contains a main power source as well as the above-stated processing circuit. The power source supplies electricity to not only the control unit but also respective devices provided inside the image forming apparatus 100.

By performing an image formation using a toner, a two-component developer, a developing device, and an image forming apparatus of the invention, it is possible to form a high-quality toner image on the photoreceptor drum 11 by the developing device 14 using a developer having an excellent fixing property and a storage stability in a state where an environmental load is low and global environmental protection is taken into account and it is possible to form a high-quality image stably without occurrence of fixing failures over a long term.

EXAMPLE

Hereinafter, referring to examples, the invention will be specifically described. In the examples, a volume average particle size of the toner and a coefficient of variation CV, a glass transition temperature (Tg) of the resin B in the binder resin, a softening temperature ($T_{1/2}$) of the resin B in the binder resin, molecular weight and a molecular weight distribution index (Mw/Mn) of the resin B in the binder resin, an acid number of the resin B in the binder resin, THF insoluble component of the resin B in the binder resin, and a melting point (Tm) of the release agent were measured as follows.

<Volume Average Particle Size of Toner and Coefficient of Variation CV>

To 50 ml of electrolyte (trade name: ISOTON-II, manufactured by Beckman Coulter, Inc.), 20 mg of a specimen and 1 ml of sodium alkylether sulfate ester (dispersant, manufactured by Kishida Chemical Co., Ltd.) were added, and admixture thus obtained was subjected to ultrasonic dispersion processing of an ultrasonic disperser (trade name: UH-50, manufactured by STM Corporation) for three minutes at an ultrasonic frequency of 20 kHz, thereby preparing a specimen for measurement. For the specimen for measurement, a particle size distribution measuring apparatus (trade name: Multisizer 3, manufactured by Beckman Coulter, Inc.) is used to measure volume particle size distribution of a specimen particle under the conditions where an aperture diameter is 20 μm and the number of particles measured is 50000 counts, and from the measurement results, measuring a particle size $d_{50}$ in which an accumulated volume from the large particle size side in an accumulated volume distribution is 50%.

<Glass Transition Temperature (Tg) of Resin B>

Using a differential scanning calorimeter (a trade name: DIAMOND DSC, manufactured by PerkinElmer Japan Co., Ltd.), 0.01 g of a sample was heated at a temperature rise rate of 10° C. per minute (10° C./min) in conformity with Japan Industrial Standards (JIS) K7121-1987, thereby measuring a DSC curve. A temperature at an intersection between an extended straight line obtained by drawing a base line on a low-temperature side of an exothermic peak corresponding to glass transition of the obtained DSC curve toward a high-temperature side and a tangent line drawn at a point where a gradient became the maximum against the curve on the low-temperature side of the peak was determined as a glass transition temperature (Tg).

<Softening Temperature ($T_{1/2}$) of Resin B>

Using a rheological properties evaluation system (a trade name: FLOW TESTER CFT-5000, manufactured by Shimadzu Corporation), 1 g of a sample was inserted into a cylinder, heated at a temperature rise rate of 6° C. per minute (6° C./min) while applying a load of 10 kgf/cm$^2$ (0.980665 MPa) such that it was extruded from a die, and a temperature at which a half of the sample flowed out from the die was determined as a softening temperature. As the die, one having an aperture of 1 mm and a length of 1 mm was used.

<Peak Top Molecular Weight, Weight Average Molecular Weight (Mw) and Molecular Weight Distribution Index (Mw/Mn) of Resin B>

Using a GPC analyzer (a trade name: HLC-8220GPC, manufactured by Tosoh Corporation), a tetrahydrofuran (hereinafter referred to as "THF") solution of 0.25% by weight of a sample was used as a sample solution at 40° C., an injection amount of the sample solution was set up at 200 and a molecular weight distribution curve was determined. A molecular weight at a top of a peak of the obtained molecular weight distribution curve was determined as a peak top molecular weight. Also, a weight average molecular weight Mw and a number average molecular weight Mn were determined from the obtained molecular weight distribution curve, and a molecular weight distribution index (Mw/Mn; hereinafter referred to simply as "Mw/Mn") which is a ratio of the weight average molecular weight Mw to the number average molecular weight Mn was determined. A molecular weight calibration curve was prepared using standard polystyrene.

<Acid Number of Resin B>

An acid number of the resin B was measured by the neutralization titration method as follows. That is, 5 g of a sample was dissolved in 50 mL of THF, and after adding a few drops of an ethanol solution of phenolphthalein as an indicator, the solution was titrated with 0.1 mol/L of a potassium hydroxide (KOH) aqueous solution. A point at which a color of the sample solution changed from colorless to purple was defined as en end point, and an acid number (mg KOH/g) was calculated from the amount of the potassium hydroxide aqueous solution required for the arrival at the end point and a weight of the sample provided for the titration.

<THF Insoluble Matter of Resin B>

In cylindrical filter paper, 1 g of a sample was charged, applied to a Soxhlet extractor and then refluxed for 6 hours upon heating using 100 L of THF as a solvent, thereby extracting a THF soluble component in the sample containing THF. After removing the solvent from an extract containing the extracted THF soluble matter, the THF soluble matter was dried at 100° C. for 24 hours, and a weight X (g) of the obtained THF soluble matter was weighed. A proportion P (% by weight) of a THF insoluble matter which is a component insoluble in THF in the resin B was calculated from the determined weight X (g) of the THF soluble matter and the weight (1 g) of the sample used for the measurement on the basis of the following equation (1). This proportion P is hereinafter referred to as "THF insoluble matter".

$$P\ (\%\ \text{by weight})=\{1\ (\text{g})-X\ (\text{g})\}/1\ (\text{g})\times 100 \quad (1)$$

<Melting Point (Tm) of Release Agent>

Using a differential scanning calorimeter (a trade name: DIAMOND DSC, manufactured by PerkinElmer Japan Co., Ltd.), the temperature of 0.01 g of a sample was raised from 20° C. to 200° C. at a rate of 10° C. per minute, subsequently dropped from 200° C. to 20° C. at a rate of 50° C. per minute and then again raised from 20° C. to 200° C. at a rate of 10° C. per minute in conformity with Japan Industrial Standards (JIS) K7121-1987. With respect to a peak of heat of fusion of the thus obtained DSC curve, a temperature of a top of the peak was determined as a melting point (Tm).

Example 1

Preparing Toner

[Pre-Mixing Step]

A toner containing 40.0 parts by weight of (weight ratio in toner: 36.2% by weight) lignin resin 1 (sodium lignosulfonate, trade name: Vanillex HW, manufactured by Nippon Paper Chemicals Co., Ltd.) as a resin A constituting a binder resin, 60 parts by weight (weight ratio in toner: 54.3% by weight) of a polyester resin 1 (glass transition temperature (Tg): 60° C., softening temperature: 110° C., peak top molecular weight: 9250, Mw/Mn=2.8, acid number: 16, THF insoluble component: 0%) as a resin B constituting a binder resin, 5.5 parts by weight (weight ratio in toner: 5.0% by weight) of a carbon black (trade name: Carbon black #44, manufactured by Mitsubishi Chemical Corporation) as a colorant, 3.3 parts by weight (weight ratio in toner: 3.0% by weight) of paraffin wax (trade name: HNP-10, manufactured by Nippon Seiro Co., Ltd., melting point (Tm): 75° C.) as a release agent, and 1.7 parts by weight (weight ratio in toner: 1.5% by weight) of a charge control agent (trade name: Copy Charge N4P VP 2481, manufactured by Clariant Japan K.K.), were mixed by a Henschel mixer (trade name: FM20C, manufactured by Mitsui Mining Co., Ltd.) under conditions where the number of revolutions of blades was 400 rpm, and processing time was five minutes, thus a material mixture 1 was obtained.

[Melt-Kneading Step]

The material mixture 1 was melt-kneaded by an extruder (PCM-65, manufactured by Ikegai, Ltd.) Operation conditions were a cylinder setting temperature of 100° C., the number of revolutions of barrel of 300 rpm, and material supplying rate of 100 kg/H. By cooling down to a room temperature, melt-kneaded material 1 was obtained.

[Pulverizing Step]

The melt-kneaded material 1 was cooled to the room temperature and coarsely pulverized thereafter by a cutter mill (trade name: VM-16, manufactured by Orient Co., Ltd.). Subsequently, the coarsely pulverized material obtained by coarse pulverizing was finely pulverized by a counter jet mill (trade name: AFG, manufactured by Hosokawa Micron Corporation), thus pulverized material 1 was obtained.

[Classifying Step]

The pulverized material 1 was classified by a rotary classifier (trade name: TSP separator, manufactured by Hosokawa Micron Corporation), and the excessively pulverized particles were classified and removed, thus a toner matrix particle 1 was obtained.

Thereafter, by adding 0.2 parts by weight of hydrophobic silica (trade name; R-974, manufactured by Nippon Aerosil Co., Ltd) as an external additive to 100 parts by weight of the toner matrix particle 1 and mixing by a Henschel mixer (trade name: FM mixer, manufactured by Mitsui Mining Co., Ltd.), 15.2 kg of a toner of Example 1 was obtained. The volume average particle size of the obtained toner was 6.7 μm and a coefficient of variation CV was 21%.

Example 2

A toner of Example 2 was obtained in the same manner as Example 1 except for that a lignin resin 1 as a resin A was 18.0 parts by weight (weight ratio in toner: 16.3% by weight), and a polyester resin 1 as a resin B was 82.0 parts by weight (weight ratio in toner: 74.2% by weight). The volume average particle size of the obtained toner was 6.7 μm and the coefficient of variation CV was 23%.

Example 3

A toner of Example 3 was obtained in the same manner as Example 1 except for that a lignin resin 1 as a resin A was 20.0 parts by weight (weight ratio in toner: 18.1% by weight), and a polyester resin 1 as a resin B was 80.0 parts by weight (weight ratio in toner: 72.4% by weight). The volume average particle size of the obtained toner was 6.8 μm and the coefficient of variation CV was 25%.

Example 4

A toner of Example 4 was obtained in the same manner as Example 1 except for that a lignin resin 1 as a resin A was 50.0 parts by weight (weight ratio in toner: 45.3% by weight), and a polyester resin 1 as a resin B was 50.0 parts by weight (weight ratio in toner: 45.3% by weight). The volume average particle size of the obtained toner was 6.7 μm and the coefficient of variation CV was 27%.

Example 5

A toner of Example 5 was obtained in the same manner as Example 1 except for that a lignin resin 1 as a resin A was 60.0 parts by weight (weight ratio in toner: 54.3% by weight), and a polyester resin 1 as a resin B was 40.0 parts by weight (weight ratio in toner: 36.2% by weight). The volume average particle size of the obtained toner was 6.7 μm and the coefficient of variation CV was 28%.

Example 6

A toner of Example 6 was obtained in the same manner as Example 1 except for using lignin resin 2 (kraft lignin, trade name: Indulin AT, manufactured by Westvaco Corp.) as a resin A. The volume average particle size of the obtained toner was 6.8 μm and the coefficient of variation CV was 24%.

Example 7

A toner of Example 7 was obtained in the same manner as Example 1 except for using polyester resin 2 (grass transition temperature (Tg): 59° C., softening temperature ($T_{1/2}$): 94° C., peak top molecular weight: 1000, Mw/Mn=2.8, acid number: 16, THF insoluble component: 0%) as a resin B. The volume average particle size of the obtained toner was 6.8 μm and the coefficient of variation CV was 23%.

Comparative Example 1

A toner of Comparative Example 1 was obtained in the same manner as Example 1 except for using polyester resin 3 (grass transition temperature (Tg): 60° C., softening temperature ($T_{1/2}$): 115° C., peak top molecular weight: 10820, Mw/Mn=3.2, acid number: 18, THF insoluble component: 0%) as a resin B. The volume average particle size of the obtained toner was 6.7 μm and the coefficient of variation CV was 24%.

Comparative Example 2

A toner of Comparative Example 2 was obtained in the same manner as Example 1 except for using polyester resin 4 (grass transition temperature (Tg): 58° C., softening temperature ($T_{1/2}$): 92° C., peak top molecular weight: 980, Mw/Mn=4.5, acid number: 16, THF insoluble component: 0%) as a resin B. The volume average particle size of the obtained toner was 6.7 μm and the coefficient of variation CV was 26%.

Comparative Example 3

A toner of Comparative Example 3 was obtained in the same manner as Example 1 except for using polyester resin 5 (grass transition temperature (Tg): 59° C., softening temperature ($T_{1/2}$): 104° C., peak top molecular weight: 4840, Mw/Mn=9.8, acid number: 22, THF insoluble component: 1%) as a resin B. The volume average particle size of the obtained toner was 6.7 μm and the coefficient of variation CV was 23%.

Comparative Example 4

A toner of Comparative Example 4 was obtained in the same manner as Example 1 except for using polyester resin 6 (grass transition temperature (Tg): 58° C., softening temperature ($T_{1/2}$): 90° C., peak top molecular weight: 960, Mw/Mn=2.6, acid number: 28, THF insoluble component: 0%) as a resin B. The volume average particle size of the obtained toner was 6.7 μm and the coefficient of variation CV was 27%.

Comparative Example 5

A toner of Comparative Example 5 was obtained in the same manner as Example 1 except for using polyester resin 7 (grass transition temperature (Tg): 60° C., softening temperature ($T_{1/2}$): 113° C., peak top molecular weight: 10820, Mw/Mn=3.2, acid number: 24, THF insoluble component: 0%) as a resin B. The volume average particle size of the obtained toner was 6.8 μm and the coefficient of variation CV was 25%.

<Preparing Two-Component Developer>

A two-component developer containing a toner prepared in Examples 1 to 7 and the Comparative Examples 1 to 5 and a carrier was prepared. As a carrier, a ferrite core carrier of which the volume average particle size is 45 μm is used and mixed for twenty minutes by a V-type mixing unit mixer (trade name: V-5, manufactured by Tokuju Corporation) such that a covering rate of a toner to a carrier is 60%, thus preparing the two-component developer.

<Evaluation of Fixing Property>

The two-component developer prepared as described above was filled in an apparatus remodeling a copier (trade name: AR-620, manufactured by Sharp Corporation) that is an image forming apparatus. On recording paper (trade name: PPC paper SF-4AM3, manufactured by Sharp Corporation), an unfixed image was formed by adjusting a sample image including a rectangular solid image section of 20 mm long and 50 mm wide so that adhering amount of a toner to the recording paper in an unfixed state at a solid image section was 0.5 mg/cm$^2$, and a fixed image was formed using an external fixing unit made by using a fixing section of the copier. Fixing process speed is set at 124 mm/sec, and temperature of a fixing roller is increased from 130° C. in steps of 10° C., and thus a minimum fixing temperature at which low-temperature offset does not appear and a temperature at which high-temperature offset starts to appear were observed. Then, a temperature range capable of fixing between a minimum fixing temperature and a temperature at which a high-temperature offset starts to appear is referred to as a fixing non-offset range. Note that, for definitions of high- and low-temperature offsets, in fixing, the case where a toner does not fix on the recording paper but keeps adhering to the fixing roller and adheres to the recording paper after the roller goes around once, is referred to as appearing offset.

Evaluation of a fixing property was performed under the following standards.

Excellent: The fixing non-offset range is at 50° C. or higher.

Good: The fixing non-offset range is at 40° C. or higher and lower than 50° C.

Not bad: The fixing non-offset range is at 30° C. or higher and lower than 40° C.

Poor: The fixing non-offset range is at lower than 30° C.

Note that, score was '3' in a case where the evaluation of the fixing property was "Excellent", the score was '2' in the case of "Good", the score was '1' in the case of "Not bad", and the score was '0' in the case of "Poor".

<Evaluation of Rubbing Resistance>

The fixed image at each temperature in the fixing non-offset range in the evaluation of the fixing property above was rubbed six times under 1 kg load by a fastness to rubbing testing machine equipped with a sand eraser (trade name: Lion eraser GAZA sand, manufactured by Lion Office Products Corp.), image density therebefore and thereafter was measured, and a rubbing remaining rate was determined by the following equation (2).

$$\text{Rubbing remaining rate (\%)}=\{(\text{Image density after rubbing six times})/(\text{Image density before rubbing})\}\times 100 \quad (2)$$

The case where the rubbing remaining rate was 80% or more was determined as "Pass", while the case where the rubbing remaining rate was less than 80% was determined as "Fail", and an allowable range of the rubbing remaining rate was obtained from a difference between a passing minimum temperature and maximum temperature, and thus evaluation of rubbing resistance was performed on the following standards.

The evaluation of rubbing resistance was performed on the following standards.

Good: The allowable range was 40° C. or higher.

Not bad: The allowable range was 30° C. or higher and lower than 40° C.

Poor: The allowable range was lower than 30° C. Note that, score was '2' in a case where the evaluation of the rubbing resistance was "Good", the score was '1' in the case of "Not bad", and the score was '0' in the case of "Poor".

<Comprehensive Evaluation>

Total score was calculated by summing up the score of the evaluation of the fixing property and the score of the evaluation of the rubbing resistance. Furthermore, the comprehensive evaluation was performed based on the flowing standards.

Good: Total score was 4 or 5.

Not bad: Total score was 2 or 3,

Poor: Total score was 0 or 1.

The evaluation results are shown in Table 1.

TABLE 1

| | Toner | | | | | | | | | | | |
|---|---|---|---|---|---|---|---|---|---|---|---|---|
| | Binder resin | | | | | | | | | | | |
| | Resin A | | | Resin B | | | | | | Ratio of | Particle size distribution | |
| | Adding amount (parts by weight) | Weight ratio in toner (% by weight) | Type | Adding amount (parts by weight) | Weight ratio in toner (% by weight) | Type | Molecular weight: Peak top molecular weight | Molecular weight: Mw/Mn | Acid number | resin A in binder resin (% by weight) | Volume average particle size (μm) | Coefficient of Variation (%) |
| Ex. 1 | 40 | 36.2 | Lignin resin 1 | 60 | 54.3 | Polyester resin 1 | 9250 | 2.8 | 16 | 40 | 6.7 | 21 |
| Ex. 2 | 18 | 16.3 | Lignin resin 1 | 82 | 74.2 | Polyester resin 1 | 9250 | 2.8 | 16 | 18 | 6.7 | 23 |
| Ex. 3 | 20 | 18.1 | Lignin resin 1 | 80 | 72.4 | Polyester resin 1 | 9250 | 2.8 | 16 | 20 | 6.8 | 25 |
| Ex. 4 | 50 | 45.3 | Lignin resin 1 | 50 | 45.3 | Polyester resin 1 | 9250 | 2.8 | 16 | 50 | 6.7 | 27 |
| Ex. 5 | 60 | 54.3 | Lignin resin 1 | 40 | 36.2 | Polyester resin 1 | 9250 | 2.8 | 16 | 60 | 6.7 | 28 |
| Ex. 6 | 40 | 36.2 | Lignin resin 2 | 60 | 54.3 | Polyester resin 1 | 9250 | 2.8 | 16 | 40 | 6.8 | 24 |
| Ex. 7 | 40 | 36.2 | Lignin resin 1 | 60 | 54.3 | Polyester resin 2 | 1000 | 2.8 | 16 | 40 | 6.8 | 23 |

| | Toner | | | | | | | | | | | |
|---|---|---|---|---|---|---|---|---|---|---|---|---|
| | Binder resin | | | | | | | | | | | |
| | Resin A | | | Resin B | | | | | | | Particle size distribution | |
| | Adding amount (parts by weight) | Weight ratio in toner (% by weight) | Type | Adding amount (parts by weight) | Weight ratio in toner (% by weight) | Type | Molecular weight: Peak top molecular weight | Molecular weight: Mw/Mn | Acid number | Resin A Adding amount (parts by weight) | Volume average particle size (μm) | Coefficient of Variation (%) |
| Comp. Ex. 1 | 40 | 36.2 | Lignin resin 1 | 60 | 54.3 | Polyester resin 3 | 10820 | 3.2 | 18 | 40 | 6.7 | 24 |
| Comp. Ex. 2 | 40 | 36.2 | Lignin resin 1 | 60 | 54.3 | Polyester resin 4 | 980 | 4.5 | 16 | 40 | 6.7 | 26 |
| Comp. Ex. 3 | 40 | 36.2 | Lignin resin 1 | 60 | 54.3 | Polyester resin 5 | 4840 | 9.8 | 22 | 40 | 6.7 | 23 |
| Comp. Ex. 4 | 40 | 36.2 | Lignin resin 1 | 60 | 54.3 | Polyester resin 6 | 960 | 2.6 | 28 | 40 | 6.7 | 27 |
| Comp. Ex. 5 | 40 | 36.2 | Lignin resin 1 | 60 | 54.3 | Polyester resin 7 | 10820 | 3.2 | 24 | 40 | 6.8 | 25 |

TABLE 1-continued

| | Fixing Property | | | | | Rubbing resistance | | | | | Comprehensive evaluation | |
|---|---|---|---|---|---|---|---|---|---|---|---|---|
| | Minimum fixing temperature (° C.) | Temperature at which high-temperature offset starting to appear (° C.) | Fixing non-offset region (° C.) | Evaluation | Score | Lower limit temperature (° C.) | Upper limit temperature (° C.) | Allowable range (° C.) | Evaluation | Score | Total Score | Evaluation |
| Ex. 1 | 170 | 220 | 50 | Excellent | 3 | 180 | 220 | 40 | Good | 2 | 5 | Good |
| Ex. 2 | 160 | 200 | 40 | Good | 2 | 180 | 200 | 20 | Poor | 0 | 2 | Not bad |
| Ex. 3 | 160 | 210 | 50 | Excellent | 3 | 180 | 210 | 30 | Not bad | 1 | 4 | Not bad |
| Ex. 4 | 180 | 230 | 50 | Excellent | 3 | 180 | 230 | 50 | Good | 2 | 5 | Good |
| Ex. 5 | 200 | 230 | 30 | Not bad | 1 | 190 | 230 | 40 | Good | 2 | 3 | Not bad |
| Ex. 6 | 180 | 220 | 40 | Good | 2 | 190 | 220 | 30 | Not bad | 1 | 3 | Not bad |
| Ex. 7 | 180 | 220 | 40 | Good | 2 | 190 | 220 | 30 | Not bad | 1 | 3 | Not bad |
| Comp. Ex. 1 | 190 | 220 | 30 | Not bad | 1 | 200 | 220 | 20 | Poor | 0 | 1 | Poor |
| Comp. Ex. 2 | 170 | 200 | 30 | Not bad | 1 | 180 | 200 | 20 | Poor | 0 | 1 | Poor |
| Comp. Ex. 3 | 190 | 220 | 30 | Not bad | 1 | 200 | 220 | 20 | Poor | 0 | 1 | Poor |
| Comp. Ex. 4 | 180 | 200 | 20 | Poor | 0 | 190 | 200 | 10 | Poor | 0 | 0 | Poor |
| Comp. Ex. 5 | 200 | 220 | 20 | Poor | 0 | 210 | 220 | 10 | Poor | 0 | 0 | Poor |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising toner particles comprising at least a binder resin, a colorant and a release agent, the binder resin comprising a resin A that is a lignin resin and a resin B that is another resin component, the resin A being selected from the group of lignin digested with acetic acid, digested and blasted lignin, kraft lignin, lignosulfonic acid, and organosolv lignin, and the resin B being a polyester resin and having a peak top molecular weight of $10^3$ to $10^4$ and an acid number of 20 or less, wherein the toner particles are obtained by mixing, melt-kneading and pulverizing the binder resin, the colorant and the release agent.

2. The toner of claim 1, wherein a ratio of the resin A in the binder resin is 20 to 50% by weight.

3. The toner of claim 1, wherein the lignin resin as the resin A is lignosulfonic acid.

4. A method for manufacturing the toner of claim 1, comprising:

a pre-mixing step of mixing at least a binder resin including a resin A that is a lignin resin and a resin B that is another resin component, a colorant and a release agent to obtain a mixture;

a melt-kneading step of melt-kneading the mixture obtained in the pre-mixing step to obtain a melt-kneaded material;

a pulverizing step of pulverizing the melt-kneaded material obtained in the melt-kneading step to obtain a pulverized material; and a classifying step of classifying the pulverized material obtained in the pulverizing step by removing excessively pulverized particles and coarse particles therefrom.

5. A two-component developer comprising the toner of claim 1 and a carrier.

6. The toner of claim 1, wherein the polyester resin has a glass transition temperature of the range of 30 to 80° C. and a softening temperature of the range of 60 to 120° C.

7. The toner of claim 6, wherein the polyester resin has a molecular weight distribution index Mw/Mn of 2.8, the molecular weigh distribution index Mw/Mn being a ratio or weight average molecular weight Mw to number average molecular weight Mn.

* * * * *